US006991502B2

(12) United States Patent
Haynes, Jr.

(10) Patent No.: US 6,991,502 B2
(45) Date of Patent: Jan. 31, 2006

(54) APPARATUS FOR SECURING A PERSON TO A WATER-TOW SPORT HANDLE

(76) Inventor: William H. Haynes, Jr., 1013 Ferrari, Modesto, CA (US) 95356

( * ) Notice: Subject to any disclaimer, the term of this patent is extended or adjusted under 35 U.S.C. 154(b) by 0 days.

(21) Appl. No.: 10/927,401

(22) Filed: Aug. 25, 2004

(65) Prior Publication Data

US 2005/0048855 A1 Mar. 3, 2005

Related U.S. Application Data

(60) Provisional application No. 60/497,512, filed on Aug. 25, 2003.

(51) Int. Cl.
*B63B 35/85* (2006.01)

(52) U.S. Cl. ..... 441/69

(58) Field of Classification Search ..... 441/69, 441/113, 114, 108, 73; 114/39.18
See application file for complete search history.

(56) References Cited

U.S. PATENT DOCUMENTS 3,494,319 A * 2/1970 Dunlap ..... 441/69
4,047,255 A * 9/1977 Kiefer ..... 441/110
4,112,865 A * 9/1978 Carn ..... 114/39.18
4,140,205 A * 2/1979 Matson ..... 182/3
4,452,161 A * 6/1984 McCoy ..... 114/39.18
D280,844 S * 10/1985 Evert ..... D21/805
4,547,165 A * 10/1985 Scheurer et al. ..... 441/112
4,720,279 A * 1/1988 Fritschen et al. ..... 441/69
5,449,309 A * 9/1995 McCarty ..... 441/69

OTHER PUBLICATIONS

"*The Water Skier*", May 2004, vol. 54, No. 2, 2 pages.

* cited by examiner

*Primary Examiner*—Stephen Avila
(74) *Attorney, Agent, or Firm*—Knobbe Martens Olson & Bear LLP

(57) ABSTRACT

An apparatus is provided, comprising a belt configured to be worn around a person's waist, and a holder secured to the belt. The holder is configured to hold onto a water-tow sport handle used for water skiing and the like. The holder can hold the water-tow sport handle while the belt is being worn around the person's waist and as the handle is being pulled away from the belt, for example by a rope attached to the rear of a watercraft. The holder advantageously comprises a plate member slidably secured to the belt, and a holding element hingedly secured to the plate member. The holding element is preferably a rigid hook that is configured to hold onto the water-tow sport handle. The hook can be hingedly secured to the plate member by a break-away pin configured to break at a threshold shear stress. During use, the pin advantageously breaks to release the portion of the holder that holds onto the water-tow sport handle when the user falls during skiing, wakeboarding, or the like. The belt preferably includes an elongated pad designed to provide support to the user's backside.

46 Claims, 6 Drawing Sheets

APPARATUS FOR SECURING A PERSON TO A WATER-TOW SPORT HANDLE

CLAIM FOR PRIORITY

This application claims priority benefit under 35 U.S.C. § 119(e) to, and incorporates fully by reference, U.S. Provisional Application No. 60/497,512 filed Aug. 25, 2003.

BACKGROUND OF THE INVENTION

Field of the Invention

This invention relates generally to water-tow sports in which a person is towed behind a watercraft, such as water skiing, wakeboarding, and the like, and more particularly to apparatus that a person uses to be towed by a watercraft.

Description of the Related Art

In various watersports in which a person is towed behind a watercraft, such as water skiing, wakeboarding, knee boarding, air chair riding, float tube (e.g., inner tubes) riding, and the like (collectively referred to herein as "water-tow sports"), the person must typically hold onto a special handle (e.g., a "water ski handle"). The handle, referred to herein as a "water-tow sport handle," is typically connected to one end of a rope having another end connected to the rear of a watercraft. A typical watercraft is a small motor boat.

A typical water-tow sport handle 10 is shown in FIGS. 1 and 2. With reference to FIG. 1, the handle comprises a rigid tubular triangle 16 including a handle segment 12 adapted to be gripped by a user. The handle segment 12 has a diameter appropriate for being gripped by a person's hands. The handle 10 is connected or configured to be connected to a rope. In use, the rope is secured to the rear of a watercraft so that a person holding the handle 10 can be pulled along behind the watercraft. FIG. 2 shows a water skier using the handle 10.

The use of a conventional water-tow sport handle requires a constant grip on the handle segment 12, which is very tiring. During those times when the user is not engaged in the immediate act of, e.g., water skiing or wakeboarding, such as after the completion of a water ski slalom course or a pass on a wakeboard, the user often desires to rest his or her hands and upper body as the watercraft continues to move. In order to rest their hands or upper body, users sometimes hook their arms through the handle 10 or extend the handle 10 between their legs. These options are dangerous because it is not as easy to release the handle 10 in the case of an emergency. For example, if the user falls while skiing with the handle 10 hooked through the user's arm, the arm can become injured as the person gets dragged along the surface of the water. Also, these methods of resting the user's hands still involve the use of upper body muscles, especially when resisting centrifugal forces while the watercraft is turning.

Some watercrafts have a rope release mechanism that a person in the watercraft can activate in an emergency situation, such as when the user falls while being towed. One limitation to this type of mechanism is that its effectiveness depends upon the person in the watercraft, who must be paying attention and must release the rope in a timely manner to avoid injuring the user.

SUMMARY OF THE INVENTION

Accordingly, it is a principle advantage of the present invention to overcome some or all of these limitations and to provide an improved method and apparatus for towing a person behind a watercraft.

In one aspect, the present invention provides an apparatus comprising a belt and a holder. The belt is configured to be worn around a person's waist. The holder is secured to the belt and configured to hold onto a water-tow sport handle while the belt is being worn around a person's waist and as the handle is being pulled away from the belt. In one embodiment, the holder comprises a plate member secured to the belt, and a holding element hingedly secured to the plate member. The holding element is configured to hold onto a water-tow sport handle. In one embodiment, the holding element comprises a rigid hook.

In another aspect, the present invention provides an apparatus comprising a belt configured to be worn around a person's waist, and a holder secured to the belt. The holder is configured to hold onto a water-tow sport handle while the belt is being worn around the person's waist and as the handle is being pulled away from the belt. The holder comprises a first portion and a second portion. The first portion has a recess configured so that shear stress in the first portion becomes concentrated at the recess. The second portion is configured to hold onto a water-tow sport handle. The holder is configured so that if the first portion breaks at the recess, the second portion will disconnect from the belt.

In another aspect, the present invention provides a holder for holding onto a water-tow sport handle, comprising a plate member and a holding element. The plate member is configured to be secured to a belt worn around a person's waist. The holding element is configured to be secured to the plate member and also to secure the plate member onto a water-tow sport handle as the handle is being pulled away from the belt.

In yet another aspect, the present invention provides a belt configured to be worn around a person's waist, comprising an elongated pad and a first strap outside of the pad. The elongated pad comprises a cushioning material inside of a cover, such that the pad is configured to support a user's back. The pad has a first end and a second end. The first strap has a first end configured to be removably secured proximate the first end of the pad, and a second end configured to be removably secured proximate the second end of the pad. The strap is configured to weave through a holder configured to hold onto a water-tow sport handle.

In still another aspect, the present invention provides a belt configured to be worn around a person's waist, comprising an elongated pad and a strap. The pad comprises a cushioning material inside of a cover and is configured to support a user's back. The pad has a first end and a second end. The strap has first and second ends. The first end of the strap is configured to be removably secured to the first end of the pad. The strap has a first portion outside of the pad. The first portion of the strap includes the first end of the strap. The strap also has a second portion extending within the pad from the second end of the pad to the first end of the pad. The first portion of the strap is configured to weave through a holder configured to hold onto a water-tow sport handle.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

Figure 1:
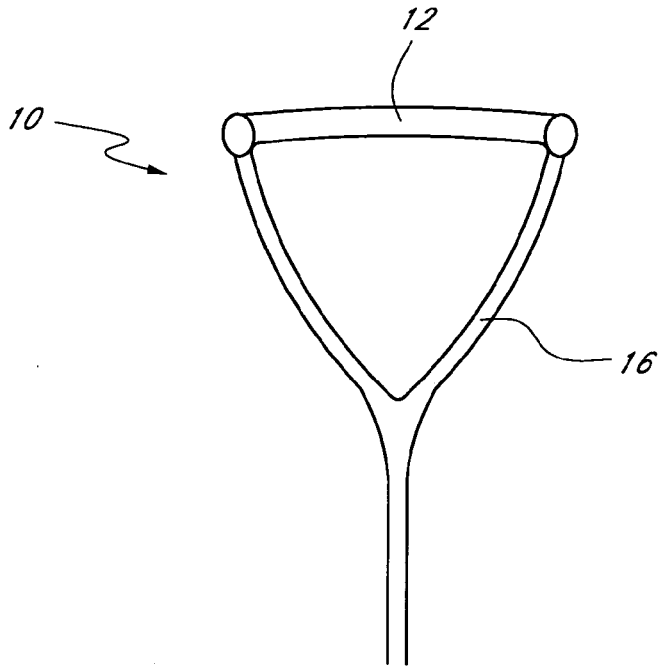
FIG. 1 (PRIOR ART)
FIG. 1 is a top view of a conventional water tow-sport handle.
Figure 2:
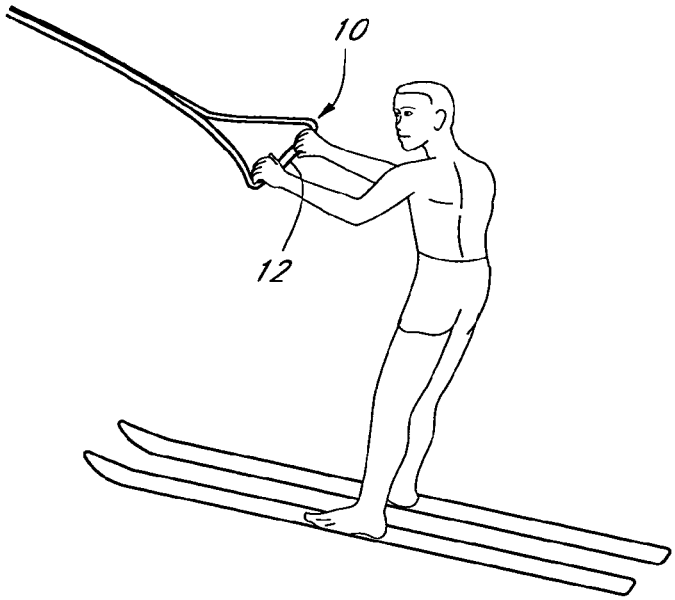
FIG. 2 (PRIOR ART)
FIG. 2 is a side view of a person using the conventional water tow-sport handle of FIG. 1.
Figure 3:
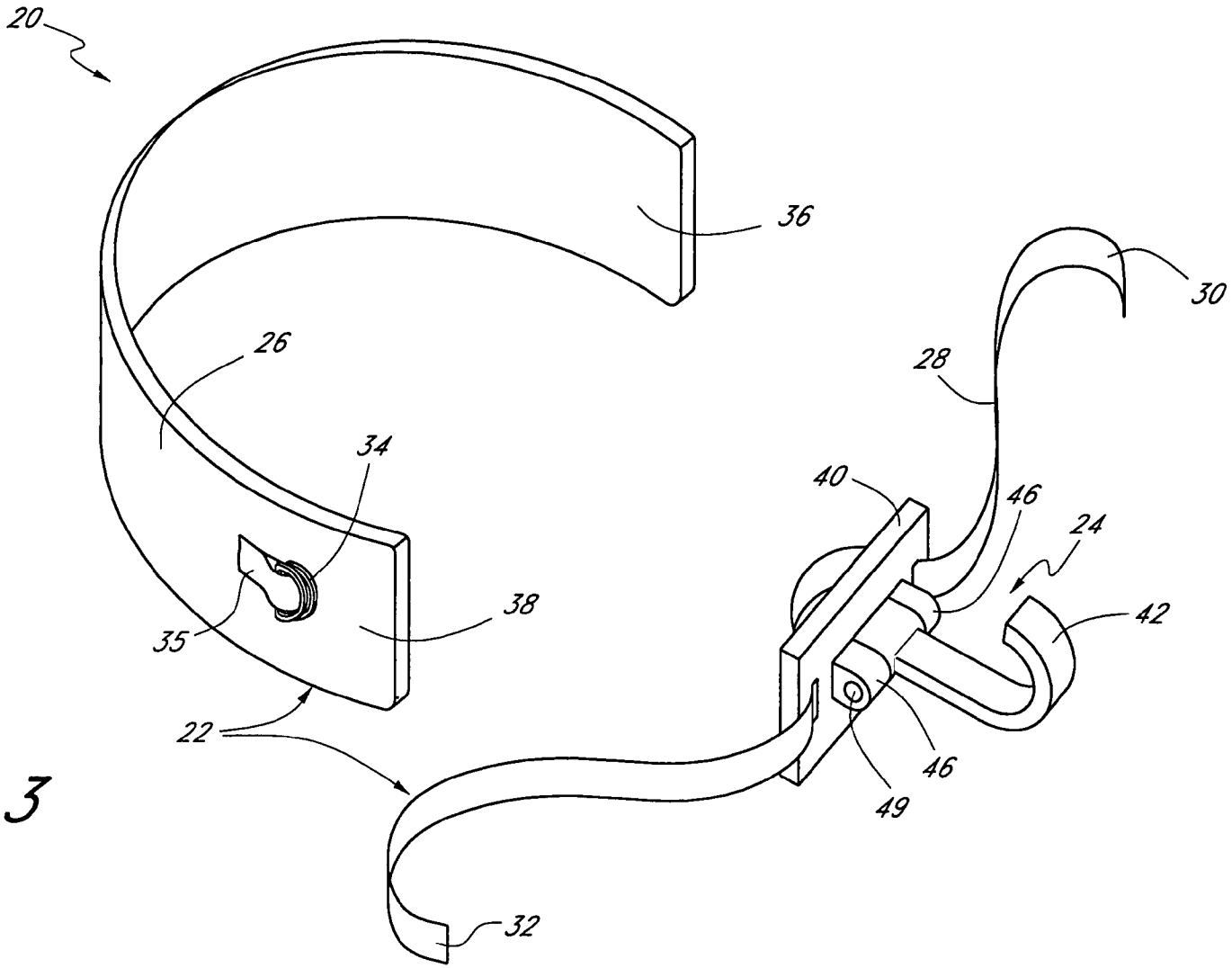
FIG. 3 is a perspective view of an apparatus for securing a user to a water-tow sport handle, according to one embodiment of the present invention.

FIG. 3 shows an apparatus 20, according to one embodiment of the present invention, for securing a user to a water tow-sport handle of the type shown in FIGS. 1–2. The illustrated apparatus 20 comprises a belt 22 and a holder 24. The belt 22 is configured to be worn around a person's waist. The holder 24 is secured to the belt 22 and is configured to hold onto the water tow-sport handle while the belt 22 is being worn around the person's waist and as the handle is being pulled away from the belt 22. It will be understood that the holder 24 can be either permanently secured to the belt 22 or configured to be removably secured thereto. As used herein, the phrase "configured to be removably secured" means designed and configured to be repeatedly secured and unsecured, without breaking a connection that is intended to be permanent. In a preferred embodiment, the holder 24 is configured to slide along the belt 22 for adjusting its position thereon. The length of the belt 22 depends upon the waist size of the user. Preferably, different belt lengths are provided for different sizes of waists.

In the illustrated embodiment, the belt 22 comprises an elongated pad 26 and a strap 28. The pad 26 is configured to provide cushioned support to a person's back when the belt 22 is worn around the person's waist. The pad 26 preferably comprises a cushioning material inside of a cover. In a preferred embodiment, the cushioning material comprises a closed-cell foam and the cover comprises a nylon-type material. However, skilled artisans will understand that any of a variety of different types of cushioning materials and covers can be used, keeping in mind the goals of making the belt 22 buoyant, suitable for use in seawater (e.g., resistant to saltwater corrosion), and/or strong enough to support the weight of a user being towed behind a watercraft. In one embodiment, the belt 22 is made of one or more materials that will float in water. In another embodiment, the belt 22 is made of one or more materials that will keep the user afloat in water when the belt is worn around the user's waist.

With continued reference to FIG. 3, the strap 28 includes a first end 30 and a second end 32. In one embodiment, both of the ends 30 and 32 are configured to be removably secured to the pad 26. Any of a variety of methods can be employed to removably secure the ends 30 and 32 of the strap 28 to the pad 26, keeping in mind the goal of avoiding disconnection during use. In the illustrated embodiment, the pad 26 includes first and second pairs of D-clips 34, which are used to removably secure the ends 30 and 32 of the strap 28 according to well known methods (e.g., passing the strap once through both D-clips and then again through only one of the D-clips). The D-clips 34 can be secured to the pad 26 in any of a variety of methods, such as by the use of strap loops 35 that are stitched into the pad 26. One pair of D-clips 34 is provided at or near a first end 36 of the pad 26, and the other pair of D-clips 34 is provided at or near a second end 38 of the pad. The first end 30 of the strap 28 can readily be removably secured to the first pair of D-clips (not shown) on the first end 36 of the pad 26, and the second end 32 of the strap 28 can readily be removably secured to the second pair of D-clips 34 on the second end 38 of the pad 26. In order to reduce the likelihood of disconnection from the D-clips 34, the strap 38 is preferably formed of a material having a relatively high degree of roughness or friction, such as strap material commonly used for backpacks, carrying cases, and the like (e.g., nylon, polypropylene, etc.). In an alternative embodiment, the D-clips 34 are omitted from the design and replaced by one or two engagement buckles, such as plastic side-release buckles sold on the web site www.plastic-buckles.com (an exemplary buckle being a Trovato TSR 101-0100 side-release buckle).

In a preferred embodiment, an internal strap similar in character to the strap 28 is stitched into and extends along substantially the entire length of the pad 26. For example, the illustrated strap loops 35 may comprise the ends of such an internal strap, each end of the internal strap being looped and stitched into itself to form the loop 35. In one embodiment, the internal strap inside the pad 26 is wider than the strap 28, and preferably as wide or almost as wide as the pad 26.

In an alternative embodiment, the first end 30 of the strap 28 is non-removably (i.e., permanently) secured to the first end 36 of the pad 26, and the second end 32 of the strap 28 can be removably secured to the second end 38 of the pad 26 by any suitable means (such as, for example, the D-clips 34 or an engagement buckle). In such an embodiment, there is of course no need for a pair of D-clips or any other apparatus at or near the first end 36 of the pad 26 for removable securement of the first end 30 of the strap 28. The first end 30 of the strap 28 can be permanently secured to the first end 36 of the pad 26 by any of a variety of methods, such as stitching the strap 28 into the pad 26. In another embodiment, the end 32 of the strap 28 is configured to be removably secured to the end 38 of the pad 26, and the strap extends across the front of the pad 26, through the end 36 of the pad, through the interior of the pad (or stitched thereon), and almost to the end 38. In such an embodiment, the end 30 of the strap 28 is at or near the end 38 of the pad 26, the strap having a first portion outside of the pad and a second portion stitched inside or on the surface of the pad. In such an embodiment, the end 30 of the strap 28 can form the strap loop 35, wherein the end 30 is looped and stitched back on itself and onto the pad 26.

Figure 4:
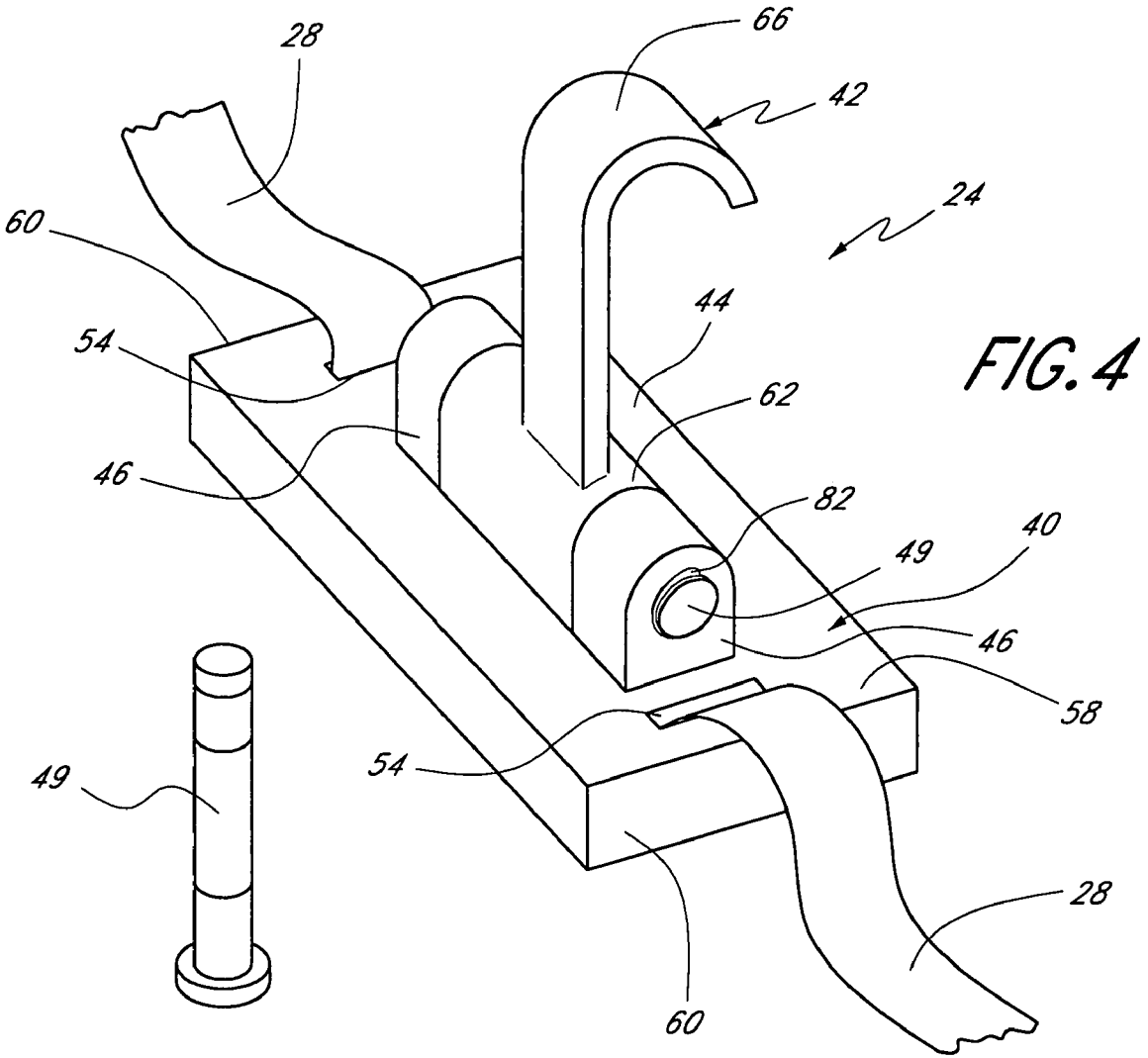
FIG. 4 is a perspective view of the holder of the apparatus of FIG. 3.
Figure 5:
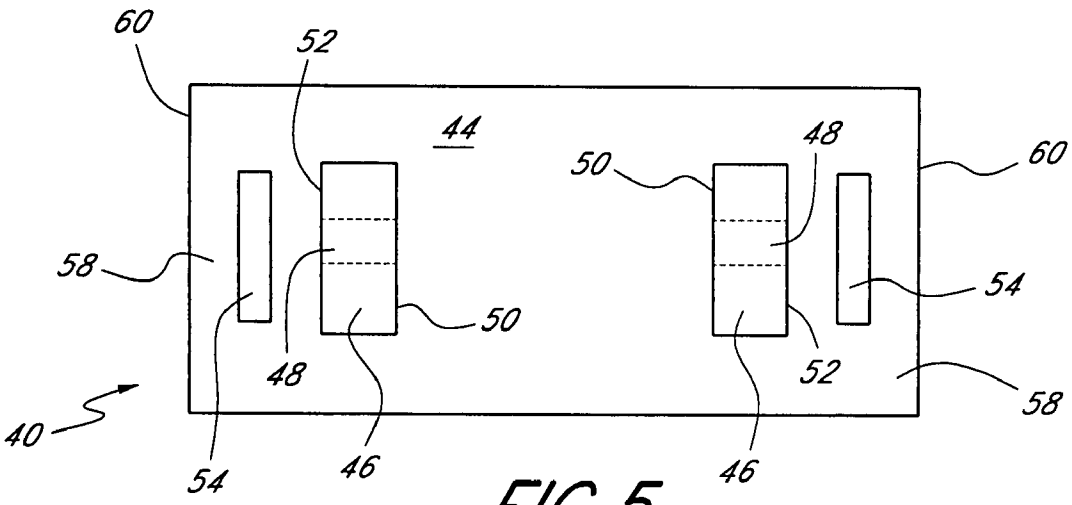
FIGS. 5–7 are front, bottom, and side views, respectively, of the plate member of the holder of FIGS. 3 and 4.
Figure 6:
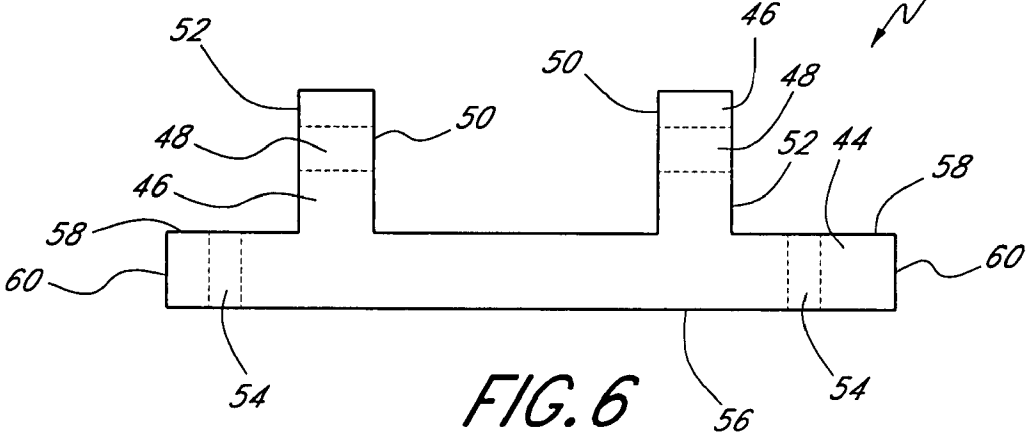
Figure 7:
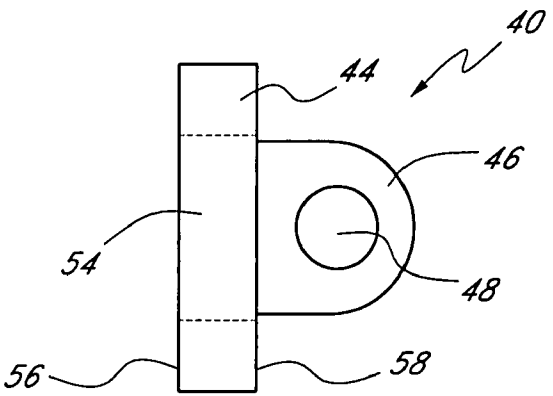

With reference to FIGS. 3 and 4, the holder 24 preferably comprises a plate member 40 secured to the belt 22, and a holding element 42 hingedly secured to the plate member 40. In the illustrated embodiment, the plate member 40 comprises a generally flat plate 44 and a pair of flange arms 46 protruding in one direction from the plate 44. The holding element 42 includes an end interposed between the flange arms 46, such that the flange arms are positioned on opposite sides of the end of the holding element. The holder 24 preferably further comprises a pin 49 extending through the holding element 42 and through at least portions of the flange arms 46. The pin 49 secures the holding element 42 between the flange arms 46 so that the holding element is rotatable with respect to the plate member 40 about a center axis of the pin.

FIGS. 4–7 show a preferred embodiment of a plate member 40 in greater detail. The plate 44 includes a back side 56, a front side 58, and ends 60. The flange arms 46 extend from the front side 58 of the plate 44. Each flange arm 46 preferably includes an inner face 50 that opposes and faces the inner face 50 of the other flange arm. Each flange arm 46 preferably also includes an outer face 52 that faces away from the other flange arm. Each of the flange arms 46 includes a pin passage 48 extending completely through the flange arm. The two pin passages 48 are aligned and configured to slidably receive the pin 49. It will be understood that one or both of the pin passages 48 may extend only partially through its associated flange arm 46, from the inner face 50 but not all the way to the outer face 52. In such configurations, the pin 49 extends only partially within such flange arm 46.

Preferably, the plate member 40 is configured to be slidably secured to the strap 28 so that a user can slide the holder 24 and thereby adjust its position relative to the pad 26. Skilled artisans will understand that the plate member 40 can have any of a variety of features for accomplishing this goal. In the illustrated embodiment, the plate member 40 includes slots 54 at or near its ends 60. Each slot 54 is sized and adapted to slidably receive the strap 28. In a preferred assembly, the strap 28 is inserted into the slots 54 of the plate member 40 such that the strap 28 extends along the front side 58 between each end 60 and associated slot 54, and along the back side 56 between the two slots 54. In this configuration, the plate member 40 can freely slide along the strap 28 without any interference between the strap and the flange arms 46.

In a preferred embodiment, the plate 44 is about 3½ inches long, about 2 inches wide, and about ¼ inch thick. The slots 54 are preferably about 1 inch long and about ⅛ inch wide, with the outside edge of one slot 54 spaced about 2 ¾ inches from the outside edge of the other slot 54. Preferably, each slot 54 is spaced apart from the outer face 52 of the nearest flange arm 46 by about 7/16 inch. The flange arms 46 are preferably about 5/16 inch thick with the inner faces 50 spaced apart by 1.004 inches. The flange arms 46 preferably protrude about ⅞ inch from the plate 44 and are ⅞ inch wide. The inner diameter of the pin passages 48 of the flange arms 46 is preferably about 0.3780 inches. The pin passages 48 are preferably spaced by about 0.254 inches from the top surface 58 of the plate 44.

Figure 8:
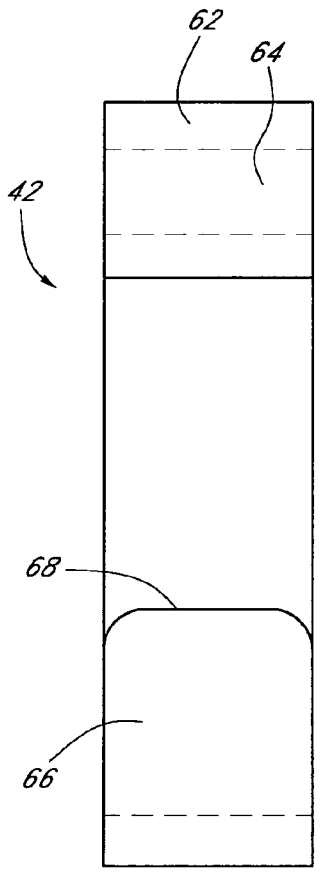
FIGS. 8 and 9 are top and side views, respectively, of the holding element of the holder of FIGS. 3 and 4.
Figure 9:
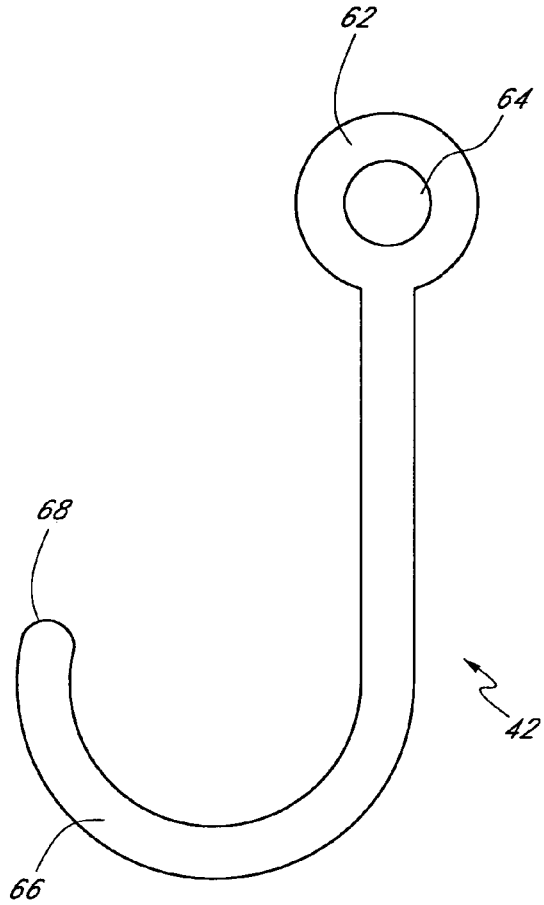

With reference to FIGS. 4, 8, and 9, the holding element 42 is configured to hold onto a water-tow sport handle, such as the handle 10 shown in FIGS. 1–2. Preferably, the holding element 42 comprises a rigid hook configured to catch onto the water-tow sport handle. In the illustrated embodiment, the holding element 42 includes a pin-receiving end 62 and a hook portion 66. The pin-receiving end 62 is sized and adapted to be positioned between the flange arms 46 of the plate member 40. The pin-receiving end 62 includes a pin passage 64 extending completely through the holding element 42. The pin passage 64 is sized and adapted to align with the pin passages 48 of the flange arms 46 and slidably receive the pin 49 (preferably a slight friction fit). Thus, the three pin passages 48 and 64 are adapted to receive the pin 49 so that the holding element 42 is hingedly secured to the plate element 40 and rotatable about a center axis of the pin 49.

The hook portion 66 of the illustrated holding element 42 is adapted to catch or hook onto a water-tow sport handle. The hook portion 66 has a hook end 68. Skilled artisans will understand that the hook portion 66 can be oriented so that it hooks onto the water-tow sport handle either from above or below. In other words, the hook end 68 can be above or below the water-tow sport handle. In alternative embodiments, the holding element 42 has non-hook configurations. For example, the holding element 42 can be configured to loop completely around the water-tow sport handle for better securement thereto. The holding element may comprise a strap that loops around the water-tow sport handle, and perhaps also around the pin 49. The holding element 42 can have one or more movable and possibly lockable elements for opening and closing a looped connection with the water-tow sport handle.

In a preferred embodiment, the holding element 42 comprises a hook having a height (from the tip of the pin-receiving end 62 to the top of the hook portion 66 in FIGS. 8 and 9) of about 3¼ inches. The pin passage 64 preferably has an inner diameter of about 0.3780 inches. In the illustrated embodiment, the diameter of the circular pin-receiving end 62 is preferably about ⅞ inch. The thickness of the holding element is preferably about ¼ inch. The radial thickness of the material surrounding the pin passage 64 is preferably about ¼ inch. The holding element 42 is preferably about 1 inch wide. Preferably, the inside and outside diameters of the hook portion 66 are about ⅝ inch and about ⅞ inch, respectively.

Figure 10:
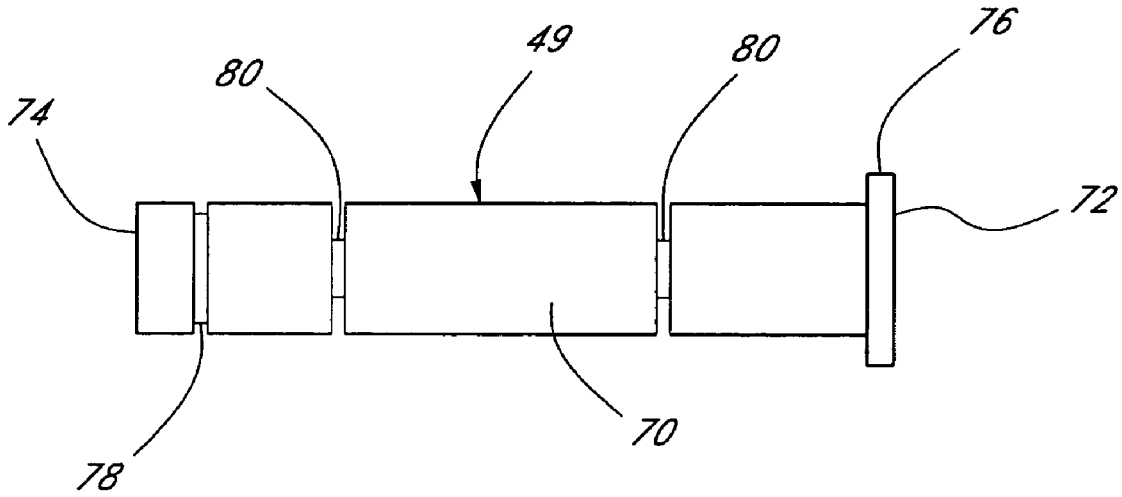
FIG. 10 is a side view of a hinge pin of the holder of FIGS. 3 and 4.

FIG. 10 shows a preferred embodiment of the pin 49. The pin 49 preferably comprises a cylindrical body 70 having a substantially uniform diameter. Preferably, the diameter of the body 70 is equal to or only slightly less than the inside diameter of the pin passages 48 (FIGS. 5–7) of the flange arms 46 of the plate member 40 (preferably a slight friction fit). As such, when the pin 49 is received within the pin passages 48, there is very little or no room for lateral movement of the pin 49. The pin 49 has a first end 72 and a second end 74. An end flange 76 is preferably provided at the first end 72. The end flange 76 preferably has a diameter that is greater than that of the pin passages 48, such that the end flange 76 is configured to abut the outer face 52 of one of the flange arms 46 of the plate member 40. The pin 49 preferably also includes a relatively shallow annular recess 78 proximate the second end 74. The recess 78 is preferably positioned such that when the pin 49 is slidably received within the pin passages 48 and when the end flange 76 abuts the outer face 52 of one of the flange arms 46 of the plate member 40, the recess 78 is generally aligned with the outer face 52 of the other flange arm 46. In a preferred embodiment, the cylindrical body 70 of the pin 49 has a diameter of about ⅜ inch.

With reference to FIG. 4, the holder 24 preferably further comprises an e-clip 82, as well-known in the art, configured to be received within the annular recess 78 when the pin 49 is received within the pin passages 48 and when the end flange 76 is in abutment with the outer face of one of the outer faces 52. The e-clip 82 preferably has an outside diameter that is greater than the inner diameter of the pin passages 48, so that the e-clip 82 prevents the pin 49 from sliding out of the pin passages 48. The e-clip 82 can define an opening such that it is configured to provide a snap-lock fit onto the pin 49 within the annular recess 78. It can thus be seen that, in the illustrated embodiment, the end flange 76 and the e-clip 82 within the annular recess 78 together prevent the pin 49 from sliding out of the pin passages 48 of the flange arms 46 of the plate member 40. Skilled artisans will understand that other means for securing the position of the pin 49 can be provided instead of the end flange 76 and e-clip 82, such as ring clamps and the like.

With continued reference to FIG. 10, the pin 49 preferably includes at least one relatively deep annular recess 80 that is positioned to be aligned with one of the two opposing inner faces 50 of the flange arms 46 of the plate member 40 when the pin 49 is received within the pin passages 48 and locked into place by the e-clip 82. More preferably, the pin 49 includes two annular recesses 80, each aligned with one of the inner faces 50. Preferably, each annular recess 80 extends around the entire circumference of the pin 49. Preferably, the one or two annular recesses 80 have a depth that is greater than that of the annular recess 78 that receives the e-clip 82. In this configuration, shear stress within the pin 49 becomes concentrated at the recesses 80. The pin 49 is thus configured to break at one or both of the recesses 80 when the shear stress reaches a breaking point threshold dependent upon the diameter of the pin at the recesses 80. In use, the pin 49 will advantageously break if the user falls while being towed (e.g., while water skiing), thus reducing the risk of injury. Skilled artisans will appreciate that other portions of the holder 24 can be made breakable to provide this safety feature, such as the hook portion 66 or the flange arms 46. In other embodiments, the holder 24 includes portions that are configured to engage and disengage to provide this feature, such as magnetically locking elements or elements that snap-lock together.

Since the shear stress in the pin 49 depends upon the weight of the user, it is contemplated that a plurality of different pin types will be provided, each with different depths of the annular recesses 80. In one embodiment, the set of pins comprises (1) a first pin 49 with a first depth of recesses 80 for users weighing more than 201 pounds (e.g., 201–350 pounds), (2) a second pin 49 with a second depth of recesses 80 for users weighing within 101–200 pounds, the second depth being greater than the first depth, and (3) a third pin 49 with a third depth of recesses 80 for users weighing 100 pounds or less, the third depth being greater than the second depth. Alternative and/or additional weight categories are also possible. The different types of pins 49 can have different colors to identify the weight class for which each pin is designed.

In a preferred embodiment, the pin 49 has a length of about 1 27/32 inches. Each of the annular recesses 78 and 80 preferably has a length of 1/32 inch. The recesses 80 are preferably spaced apart by 1.004 inches. The end flange 72 preferably has a length of 1/16 inch and a diameter of 1/2 inch. The annular recess 78 preferably has a diameter of about 5/16 inch. In a preferred embodiment, three different types of pins 49 are provided, wherein the diameter of the annular recesses 80 is 1/4 inch, 3/16 inch, and 1/8 inch, the selection of which pin to use being based upon the user's weight. As mentioned above, the cylindrical body 70 preferably has a diameter of 3/8 inch.

In a preferred embodiment, the holder 24 is made of a plastic type material, such as Noryl™. The holding element 42 can be made of a material that floats in water, so that the user can easily locate and retrieve the floating holding element if it breaks away from the rest of the holder 24. In another embodiment, the holder 24 further comprises a buoyant element that can be fitted thereon to make the holder float. Preferably, the buoyant element is designed to be fitted onto the holding element 42. For example, the holder 24 can include a foam ring (e.g., oval shaped) or sleeve configured to be slidably received onto the hook portion 66. The parts of the holder 24 are preferably manufactured by injection molding, as known in the art. Preferably, the e-clip 82 is metallic. However, the e-clip 82 can be made of other materials as well, keeping in mind the goal of securing the pin 49 within the pin passages 48 of the flange arms 46 of the plate element 40. In a preferred embodiment, the belt 22 includes a pad 26 and the strap 28 having widths of 4 inches and 1 inch, respectively. The pad 26 and strap 28 are preferably sewn together in the manufacturing process.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications thereof. Thus, it is intended that the scope of the present invention herein disclosed should not be limited by the particular disclosed embodiments described above, but should be determined only by a fair reading of the claims that follow.

What is claimed is:

1. An apparatus comprising:

a belt configured to be worn around a person's waist; and a holder secured to the belt and configured to hold onto a water-tow sport handle without the person's assistance while the belt is being worn around the person's waist and as the handle is being pulled away from the belt, wherein the holder is configured to automatically release the water-tow sport handle from the belt when a force pulling the handle exceeds a threshold.

2. The apparatus of claim 1, wherein the belt comprises an elongated pad configured to provide cushioned support to a person's back when the belt is worn around the person's waist.

3. The apparatus of claim 2, wherein the pad comprises a cushioning material inside of a cover.

4. The apparatus of claim 3, wherein the cushioning material comprises foam and the cover comprises nylon.

5. The apparatus of claim 2, wherein the belt further comprises a strap secured to the pad.

6. The apparatus of claim 5, wherein the strap has first and second ends configured to be removably secured to the pad.

7. The apparatus of claim 6, wherein the pad includes first and second pairs of D-clips, the first end of the strap being configured to be removably secured to the first pair of D-clips, the second end of the strap being configured to be removably secured to the second pair of D-clips.

8. The apparatus of claim 6, further comprising engagement buckles configured to secure the first and second ends of the straps to the pad.

9. The apparatus of claim 5, wherein the strap has a first end non-removably secured to the pad and a second end configured to be removably secured to the pad.

10. The apparatus of claim 9, wherein the pad includes a pair of D-clips, the second end of the strap configured to be removably secured to the pair of D-clips.

11. The apparatus of claim 9, further comprising an engagement buckle configured to secure the second end of the strap to the pad.

12. The apparatus of claim 1, wherein the holder comprises a rigid hook configured to catch onto a water-tow sport handle.

13. The apparatus of claim 1, wherein the holder comprises:

a plate member secured to the belt; and a holding element hingedly secured to the plate member, the holding element configured to hold onto a water-tow sport handle.

14. The apparatus of claim 13, wherein the holding element comprises a hook configured to hook onto a water-tow sport handle.

15. The apparatus of claim 13, wherein the plate member comprises a plate and a pair of flange arms protruding from the plate, the holding element having a portion interposed between the flange arms, the holder further comprising a pin extending through the holding element and through at least portions of the flange arms, the holding element being rotatable with respect to the plate member about a center axis of the pin.

16. The apparatus of claim 15, wherein each of the flange arms includes an inner face that opposes an inner face of the other flange arm, the pin including at least one annular recess aligned with one of the two opposing inner faces of the flange arms.

17. The apparatus of claim 16, wherein the pin includes two annular recesses, each of which is aligned with one of the two opposing inner faces of the flange arms.

18. The apparatus of claim 15, wherein each of the flange arms includes an outer face that faces away from the other flange arm, the pin extending completely through each of the flange arms, the pin including an end having an end flange abutting the outer face of a first of the flange arms, the pin including an annular recess substantially aligned with the outer face of a second of the flange arms, the holder further comprising a E-clip received within the annular recess and abutting the outer face of the second of the flange arms to prevent the pin from being slidably removed from the flange arms.

19. The apparatus of claim 13, further comprising a pin hingedly securing the holding element to the plate member, the pin having at least one annular recess at which shear stress becomes concentrated within the pin.

20. The apparatus of claim 13, wherein the belt extends through a pair of slots of the plate member.

21. The apparatus of claim 13, further comprising a buoyant element configured to be slidably received onto the holding element.

22. The apparatus of claim 21, wherein the buoyant element is made of foam.

23. The apparatus of claim 1, wherein the holder comprises first and second portions, the first portion having a recess configured so that shear stress in the first portion becomes concentrated at the recess, the second portion configured to hold onto a water-tow sport handle, the holder configured so that if the first portion breaks at the recess, the second portion will disconnect from the belt.

24. An apparatus comprising:

a belt configured to be worn around a person's waist; and a holder secured to the belt and configured to hold onto a water-tow sport handle while the belt is being worn around a person's waist and as the handle is being pulled away from the belt, the holder comprising:

a first portion having a recess configured so that shear stress in the first portion becomes concentrated at the recess; and a second portion configured to hold onto a water-tow sport handle, the holder configured so that if the first portion breaks at the recess, the second portion will disconnect from the belt.

25. A holder for holding onto a water-tow sport handle, comprising:

a plate member configured to be secured to a belt worn around a person's waist; and a holding element configured to be secured to the plate member and also to secure the plate member onto a water-tow sport handle without the persons's assistance as the handle is being pulled away from the belt, the holding element being constructed so as to automatically detach from the plate member when pulled with a force exceeding a threshold.

26. The holder of claim 25, wherein the holding element includes a first portion configured to be hingedly secured to the plate member, and a second portion configured to hold onto a water-tow sport handle.

27. The holder of claim 26, wherein the second portion comprises a hook.

28. The holder of claim 26, wherein the plate member comprises a plate and two flange arms protruding from the plate, the flange arms and the first portion of the holding element having pin passages configured to receive a pin, the holder further comprising a pin configured to be slidably received within the pin passages of the flange arms and the first portion of the holding element.

29. The holder of claim 28, wherein the pin includes one or more recesses in a peripheral surface of the pin, such that shear stress in the pin becomes concentrated at the one or more recesses.

30. The holder of claim 29, wherein the pin comprises a substantially cylindrical body having a substantially uniform diameter, the one or more recesses extending along an entire circumference of the cylindrical body.

31. The holder of claim 25, wherein the plate member includes a pair of slots configured to receive the belt so that the plate member is slidable along the belt when the belt extends through both slots.

32. The holder of claim 25, wherein one or both of the plate member and the holding element are formed of a material that floats in water.

33. An apparatus belt configured to be worn around a person's waist, comprising:

an elongated pad comprising a cushioning material inside of a cover, the pad configured to support a user's back, the pad having a first end and a second end;

a first strap outside of the pad, the first strap having a first end configured to be removably secured proximate the first end of the pad, and a second end configured to be removably secured proximate the second end of the pad; and a holder configured to hold onto a water-tow sport handle without the user's assistance, the strap being configured to weave through the holder, the holder being configured to automatically release the handle from the strap when a force between the handle and the holder exceeds a threshold.

34. The belt of claim 33, further comprising a second strap extending within the cover between the first and second ends of the pad.

35. The belt of claim 33, wherein the first end of the pad includes a first pair of D-clips configured to removably secure the first end of the strap, and the second end of the pad includes a second pair of D-clips configured to removably secure the second end of the strap.

36. A belt configured to be worn around a person's waist, comprising:

an elongated pad comprising a cushioning material inside of a cover, the pad configured to support a user's back, the pad having a first end and a second end; and a strap having first and second ends, the first end of the strap configured to be removably secured to the first end of the pad, the strap having a first portion outside of the pad, the first portion of the strap including the first end of the strap, the strap having a second portion extending within the pad from the second end of the pad to the first end of the pad, the first portion of the strap being configured to weave through a holder configured to hold onto a water-tow sport handle.

37. The belt of claim 36, wherein the second end of the strap emerges at the first end of the pad, the second end of the strap being stitched in a loop against itself.

38. The belt of claim 37, wherein the loop extends through a pair of D-clips configured to removably secure the first end of the strap to the first end of the pad.

39. The belt of claim 36, wherein the second portion of the strap is stitched into the pad.

40. An apparatus comprising:

a belt configured to be worn around a person's waist; and a holder secured to the belt and configured to hold onto a water-tow sport handle while the belt is being worn around a person's waist and as the handle is being pulled away from the belt, the holder comprising:

a plate member secured to the belt, the plate member comprising a plate and a pair of flange arms protruding from the plate, each of the flange arms including an inner face that opposes an inner face of the other flange arm;

a holding element hingedly secured to the plate member and configured to hold onto a water-tow sport handle, the holding element having a portion interposed between the flange arms; and a pin extending through the holding element and through at least portions of the flange arms, the pin including at least one annular recess aligned with one of the two opposing inner faces of the flange arms, wherein the holding element is rotatable with respect to the plate member about a center axis of the pin.

41. The apparatus of claim 40, wherein the pin includes two annular recesses, each of which is aligned with one of the two opposing inner faces of the flange arms.

42. An apparatus comprising:

a belt configured to be worn around a person's waist; and a holder secured to the belt and configured to hold onto a water-tow sport handle while the belt is being worn around a person's waist and as the handle is being pulled away from the belt, the holder comprising:

a plate member secured to the belt, the plate member comprising a plate and a pair of flange arms protruding from the plate, each of the flange arms including an outer face that faces away from the other flange arm;

a holding element hingedly secured to the plate member and configured to hold onto a water-tow sport handle, the holding element having a portion interposed between the flange arms;

a pin extending through the holding element and completely through each of the flange arms, the pin including an end having an end flange abutting the outer face of a first of the flange arms, the pin including an annular recess substantially aligned with the outer face of a second of the flange arms, the holding element being rotatable with respect to the plate member about a center axis of the pin; and an E-clip received within the annular recess and abutting the outer face of the second of the flange arms to prevent the pin from being slidably removed from the flange arms.

43. An apparatus comprising:

a belt configured to be worn around a person's waist;

a holder secured to the belt and configured to hold onto a water-tow sport handle while the belt is being worn around a person's waist and as the handle is being pulled away from the belt, the holder comprising:

a plate member secured to the belt; and a holding element hingedly secured to the plate member, the holding element configured to hold onto a water-tow sport handle; and a pin hingedly securing the holding element to the plate member, the pin having at least one annular recess at which shear stress becomes concentrated within the pin.

44. A holder for holding onto a water-tow sport handle, comprising:

a plate member configured to be secured to a belt worn around a person's waist, the plate member comprising a plate and two flange arms protruding from the plate; and a holding element configured to be secured to the plate member and also to secure the plate member onto a water-tow sport handle as the handle is being pulled away from the belt, the holding element including a first portion configured to be hingedly secured to the plate member, and a second portion configured to hold onto a water-tow sport handle, the flange arms and the first portion of the holding element having pin passages configured to receive a pin; and a pin configured to be slidably received within the pin passages of the flange arms and the first portion of the holding element, the pin including one or more recesses in a peripheral surface of the pin, such that shear stress in the pin becomes concentrated at the one or more recesses.

45. The holder of claim 44, wherein the pin comprises a substantially cylindrical body having a substantially uniform diameter, the one or more recesses extending along an entire circumference of the cylindrical body.

46. An apparatus comprising:

a belt configured to be worn around a person's waist; and a holder secured to the belt and configured to hold onto a generally horizontally oriented rigid water-tow sport handle without the person's assistance while the belt is being worn around the persons s waist and as the handle is being pulled away from the belt, the holder comprising a rigid hook that pivots about an axis that is generally parallel to the handle, the hook configured to hook onto the handle from below the handle.

* * * * *